US008971158B2

(12) United States Patent
Grossenbacher et al.

(10) Patent No.: US 8,971,158 B2
(45) Date of Patent: Mar. 3, 2015

(54) METHOD FOR SECURING A DECORATION TO AN EXTERNAL TIMEPIECE ELEMENT AND EXTERNAL ELEMENT MADE IN ACCORDANCE WITH THIS METHOD

(75) Inventors: Pascal Grossenbacher, Neuchatel (CH); Thomas Froelicher, Le Landeron (CH)

(73) Assignee: The Swatch Group Research and Development Ltd., Marin (CH)

( * ) Notice: Subject to any disclaimer, the term of this patent is extended or adjusted under 35 U.S.C. 154(b) by 303 days.

(21) Appl. No.: 13/551,192

(22) Filed: Jul. 17, 2012

(65) Prior Publication Data

US 2013/0021882 A1 Jan. 24, 2013

(30) Foreign Application Priority Data

Jul. 20, 2011 (EP) ..... 11005932

(51) Int. Cl.

| | |
|---|---|
| ***G04B 19/10*** | (2006.01) |
| ***G04B 19/12*** | (2006.01) |
| ***G04B 19/28*** | (2006.01) |
| ***G04B 47/04*** | (2006.01) |
| ***A44C 17/04*** | (2006.01) |
| ***G04B 45/00*** | (2006.01) |

(52) U.S. Cl.

CPC ..... *G04B 47/042* (2013.01); *A44C 17/04* (2013.01); *G04B 45/0076* (2013.01); *G04B 19/103* (2013.01); *G04B 19/12* (2013.01); *G04B 19/283* (2013.01)

USPC ..... 368/232; 368/281; 368/285; 368/295; 63/21; 63/34

(58) Field of Classification Search

USPC ..... 368/223, 228, 232, 281, 285, 295; 63/4, 63/15, 21, 26, 32, 34

See application file for complete search history.

(56) References Cited

U.S. PATENT DOCUMENTS

| | | | | |
|---|---|---|---|---|
| 4,154,282 | A * | 5/1979 | Kull | 164/9 |
| 4,543,803 | A * | 10/1985 | Keyasko | 63/37 |
| 4,710,276 | A * | 12/1987 | Kull | 29/10 |
| 6,125,516 | A * | 10/2000 | Winkler | 29/10 |
| 2009/0249608 | A1 * | 10/2009 | Podszuweit et al. | 29/527.1 |
| 2011/0259753 | A1 * | 10/2011 | Grossenbacher et al. | 205/162 |

FOREIGN PATENT DOCUMENTS

| | | | |
|---|---|---|---|
| EP | 0 620 987 | A1 | 10/1994 |
| FR | 2 627 512 | A1 | 8/1989 |
| WO | WO 2010/081557 | A1 | 7/2010 |

OTHER PUBLICATIONS

European Search Report issued Jan. 4, 2012 in corresponding European Application No. 11 00 5932 filed on Jul. 20, 2011 (with an English Translation).

* cited by examiner

*Primary Examiner* — Vit W Miska

(74) *Attorney, Agent, or Firm* — Oblon, McClelland, Maier & Neustadt, L.L.P.

(57) ABSTRACT

Method for securing a decoration (1) to an external timepiece element (2) coated with a galvanically deposited metallic layer (3). Instead of the decoration (1), a dummy part (5) is temporarily placed in the hole (4) pierced in the external element (2), and the galvanic deposition (3) is then carried out. After the deposition has been levelled, the dummy part (5) is removed and the decoration is placed in the hole (4).

13 Claims, 3 Drawing Sheets

METHOD FOR SECURING A DECORATION TO AN EXTERNAL TIMEPIECE ELEMENT AND EXTERNAL ELEMENT MADE IN ACCORDANCE WITH THIS METHOD

This application claims priority from European Patent Application No. 11005932.6 filed Jul. 20, 2011, the entire disclosure of which is incorporated herein by reference.

The present invention relates to a method for securing a decoration or an insert to an external timepiece element coated with a galvanically deposited metallic layer and to an external element made in accordance with this method.

When a decoration is inserted or incorporated in an external timepiece element, and the latter has to be coated with a galvanically deposited metallic layer, the element is first of all at least partially pierced, and the hole thereby formed is adapted to the dimensions of the decoration to be incorporated.

If the galvanic deposition is performed after this operation, the hole will be obstructed by the deposition and another hole machining operation will be necessary with the risk that the deposition will be scratched around the entrance to the hole, which will then not have clean edges, which is aesthetically unacceptable for an upmarket timepiece.

Thus, in addition to complying with the statements contained in first paragraph of this description, and in addition to including the following first series of steps: taking a substrate used as an external element, taking a decoration intended to be incorporated in the substrate and perforating the substrate to the dimensions of the decoration to be incorporated, the present method is characterized in that there is inserted into the hole thereby formed a dummy part adapted to the dimensions of said hole, in that a metallic layer is galvanically deposited on said substrate, in that, if necessary, the metallic layer is levelled, the dummy part is removed from the substrate and the decoration is inserted in the substrate which is secured, for example, by adhesive bonding.

The present invention also concerns the external timepiece element made in accordance with the above method.

The features and advantages of the present invention will appear from the following description, given with reference to the annexed drawings, and providing, by way of explanatory, but non-limiting example, an advantageous embodiment. In the drawings.

Figure 1:
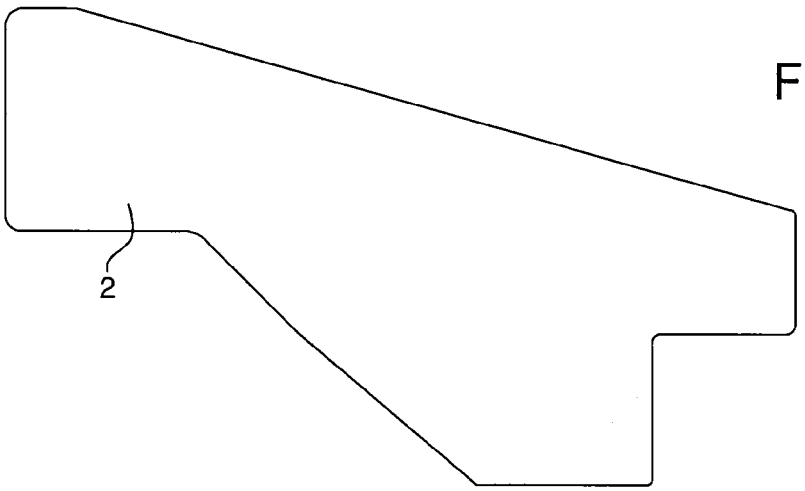
FIG. 1 shows a radial cross-section of a substrate used as an external element, which in this case is a watch bezel.
Figure 2:
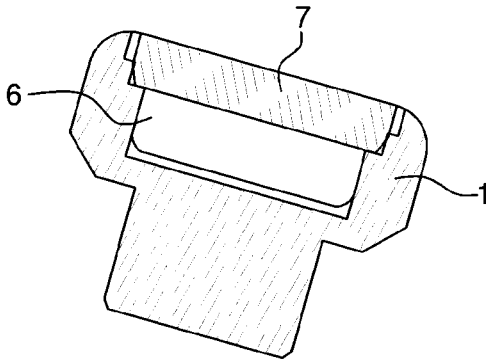
FIG. 2 shows a decoration to be incorporated in the substrate, which in this case is a phosphorescent disc.
Figure 3:
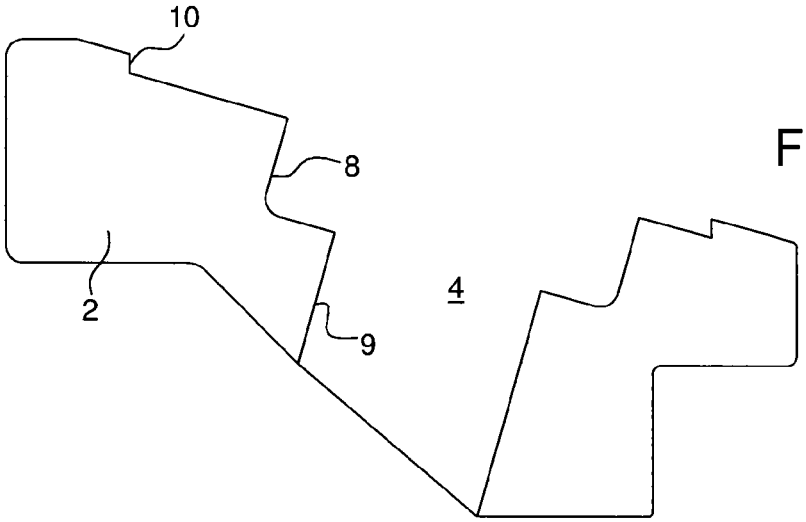
FIG. 3 shows the substrate perforated in order to insert the decoration.

FIG. 1 shows an external timepiece element 2, referred to as the "substrate", in which a decoration will be incorporated. More specifically here the element is a watch bezel. A decoration 1 is shown in FIG. 2. It is a phosphorescent disc 6 deposited underneath a sapphire crystal 7, carried by decoration 1. This disc is known by the name of "Luminova" (registered trademark). In FIG. 3, substrate 2 is perforated on both sides. According to a variant the hole may be a blind hole. This perforation includes several stages or shoulders. Stages

8 and 9 are for receiving disc 1 and stage 10 is performed so as to receive the galvanic deposition as will be seen below.

Figure 4:
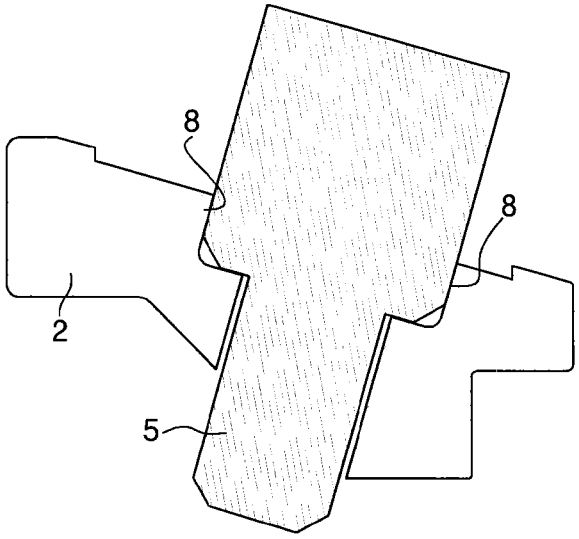
FIG. 4 shows a dummy part inserted into the hole in the substrate.

A dummy part 5 is inserted into the perforated substrate 2 as shown in FIG. 4. This dummy part is a temporary insert and forms the essential part of the present invention. It prevents the future galvanic deposition from penetrating hole 8, which is why dummy part 5 is sized to fit the geometry of hole 8 perfectly so as to prevent any deposition infiltrating across the diameter concerned. Dummy part 5 is made of insulating material, for example, plastic material. It may also be obtained by polyoxymethylene (POM) injection moulding.

Figure 5:
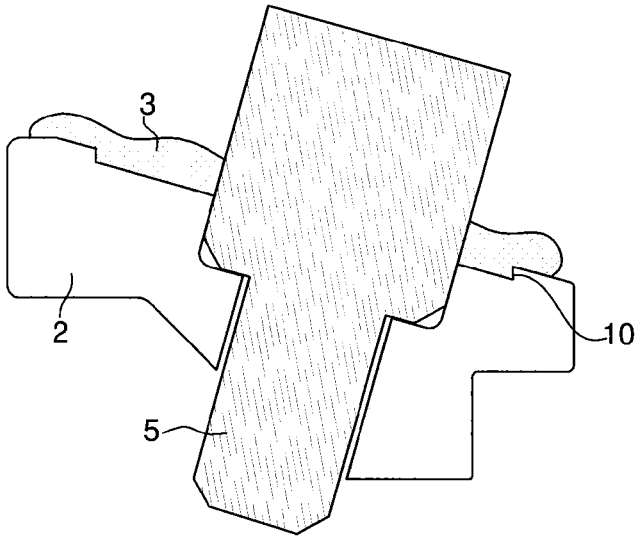
FIG. 5 shows the galvanic deposition operation.
Figure 6:
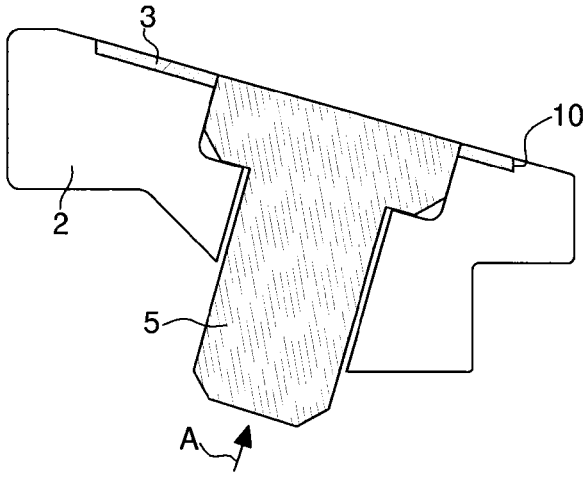
FIG. 6 shows the operation of levelling the galvanic deposition.

FIG. 5 shows the galvanic deposition operation symbolised by the FIG. 3. If substrate 2 is metallic, steel or brass for example, the electrodeposition operation is performed without any problems, although the areas which must not be electrodeposited must be spared, which is not simple. In the preferred case here where the substrate is made of insulating material, for example $ZrO_2$ ceramic (zirconium dioxide), or a suitable plastic material, substrate 2 must be coated with a metallisation which will precede the actual electrodeposition. Thus, for example, a fine layer of chromium (50 nm) and gold (50 nm) may be deposited by PVD, to which the galvanic deposition will be able to adhere properly. The deposition may be 5N18 gold. FIG. 5 shows that deposition 3 may be irregular. In such case, and if necessary, the deposition is then levelled so that it only remains in the desired place, in this case not exceeding stage 10. FIG. 6 shows how the substrate 2 looks after levelling. This Figure also shows that dummy part 5 has been levelled with deposition 3. Once this operation has finished, dummy part 5 can be removed from substrate 2 by pushing it backwards in the direction of arrow A.

Figure 7:
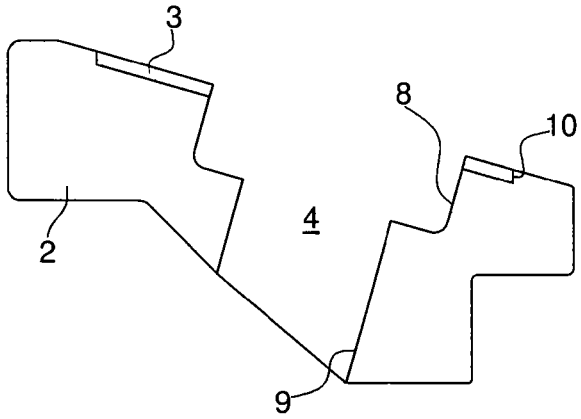
FIG. 7 shows the substrate free of the dummy part.
Figure 8:
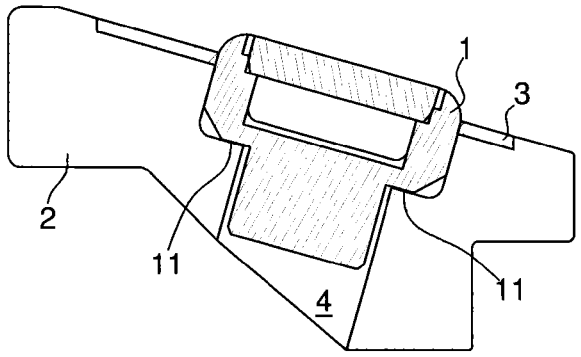
FIG. 8 shows the finished substrate provided with the decoration.

FIG. 7 shows substrate 2 free of dummy part 5. Since no adherence occurs between the head of the dummy part and galvanic deposition 3, the periphery of the deposition looks clean and sharp. Decoration 1 can finally then be inserted into the space thereby prepared as shown in FIG. 8. The decoration is held in place by adhesive applied to the places marked 11 in FIG. 8. The decoration may also be driven in or secured by another appropriate securing method.

The description that has just been given places the emphasis on a single decoration 1, in this case a phosphorescent disc fitted to a rotating watch bezel. This disc could for example be fitted to a diver's watch to indicate the decompression stops to be observed. It is clear that several decorations could be incorporated in the same way in one substrate, for example a bezel. Twelve symbols indicating the time could therefore be incorporated in said bezel.

As stated above, the present invention concerns not only the method implemented to make an external element fitted with a decoration, but also the actual external element made in accordance with said method, said element or substrate being made of conductive material, for example steel, or non-conductive material, for example a ceramic material. More specifically, the element taken by way of example here is a watch bezel, but this could also be the middle part or dial of the watch. Likewise, the decoration associated with the external element is not limited to a phosphorescent disc, but could be hour symbols inserted in a bezel as suggested above.

What is claimed is:

1. A method for securing a decoration to an external timepiece element coated with a galvanically deposited metallic layer, including the following series of steps:

a) taking a substrate used as external element;

b) taking a decoration for incorporation into the substrate;

c) at least partially perforating the substrate to the dimensions of the decoration to be incorporated;

d) the method being wherein a dummy part, adapted to the dimensions of hole thereby formed is inserted into the hole, e) a metallic layer is galvanically deposited on the substrate, f) if necessary, the metallic layer is then levelled, g) the dummy part is removed from the substrate and h) the decoration is inserted into the substrate which is secured by adhesive bonding or is driven therein.

2. The method according to claim 1, wherein the substrate is an insulating material, in that step e) is preceded by a metallising step including a fine layer of chromium and gold and wherein the galvanically deposited metallic layer is a gold layer.

3. An external timepiece element comprising a substrate including an upper surface, a stepped through hole being made in the upper surface, said through hole having a plurality of steps, among which an upper step, said through hole having a plurality of vertical walls extending substantially perpendicular to said upper surface of the substrate and a plurality of shoulders defining in pairs with said vertical walls said steps, wherein said upper step of said through hole is filled with a metallic layer having an upper surface, wherein said upper surface of said metallic layer and said upper surface of said substrate in the vicinity of said through hole are flush with each other, wherein said vertical walls of said through hole are free of any metal layer and wherein said external timepiece element further includes a decoration, said decoration being accommodated in said through hole.

4. The external element according to claim 3, wherein said element is a watch bezel.

5. The external element according to claim 3, wherein said element is a watch dial.

6. The external element according to claim 5, wherein the decoration is a phosphorescent disc.

7. The external element according to claim 5 or 6, wherein the decoration is series of hour symbols.

8. The external element according to claim 3, wherein said substrate comprises a conductive material.

9. The external element according to claim 8, wherein said substrate comprises steel.

10. The external element according to claim 3, wherein said substrate comprises a non-conductive material.

11. The external element according to claim 10, wherein said substrate comprises a ceramic material.

12. The external element according to claim 10, wherein said substrate further comprises a metallization coating deposited on said non-conductive material.

13. The external element according to claim 3, wherein said metallic layer comprises gold.

* * * * *